US009327253B2

(12) United States Patent
Bunoz et al.

(10) Patent No.: US 9,327,253 B2
(45) Date of Patent: May 3, 2016

(54) FOAM PUMP

(75) Inventors: Etienne Bunoz, Hailsham (GB); Jeremy Rossall, East Preston (GB); Caryi Kwong, Kwai Chung (HK)

(73) Assignee: Brightwell Dispensers Limited, Newhaven (GB)

( * ) Notice: Subject to any disclaimer, the term of this patent is extended or adjusted under 35 U.S.C. 154(b) by 384 days.

(21) Appl. No.: 13/704,593

(22) PCT Filed: Jun. 15, 2010

(86) PCT No.: PCT/GB2010/001175

§ 371 (c)(1),
(2), (4) Date: Aug. 6, 2013

(87) PCT Pub. No.: WO2011/157975

PCT Pub. Date: Dec. 22, 2011

(65) Prior Publication Data

US 2013/0315031 A1 Nov. 28, 2013

(51) Int. Cl.

| | |
|---|---|
| ***B01F 15/02*** | (2006.01) |
| ***B67D 7/76*** | (2010.01) |
| ***B01F 5/12*** | (2006.01) |
| ***B01F 3/04*** | (2006.01) |
| ***B05B 7/00*** | (2006.01) |
| ***B05B 11/00*** | (2006.01) |

(52) U.S. Cl.

CPC ..... *B01F 5/12* (2013.01); *B01F 3/04992* (2013.01); *B05B 7/0037* (2013.01); *B05B 11/007* (2013.01); *B05B 11/3001* (2013.01); *B05B 11/3015* (2013.01); *B05B 11/3087* (2013.01)

(58) Field of Classification Search

CPC .... B05B 7/0037; B01F 13/06; B01F 3/04992
USPC ..... 222/190, 110, 139; 366/181.8, 182.2
See application file for complete search history.

(56) References Cited

U.S. PATENT DOCUMENTS

| | | | | |
|---|---|---|---|---|
| 6,409,050 | B1 | 6/2002 | Ophardt et al. | |
| 6,626,332 | B2 * | 9/2003 | Ehrensperger et al. | 222/190 |
| 2006/0273114 | A1 * | 12/2006 | Ophardt | 222/321.1 |
| 2009/0039110 | A1 * | 2/2009 | Brouwer | 222/190 |

FOREIGN PATENT DOCUMENTS

| | | |
|---|---|---|
| CH | 676227 A5 | 12/1990 |
| EP | 0 613 728 | 9/1994 |
| EP | 0 706 830 A1 | 4/1996 |

(Continued)

*Primary Examiner* — Tony G Soohoo
*Assistant Examiner* — Anshu Bhatia
(74) *Attorney, Agent, or Firm* — Levy & Grandinetti

(57) ABSTRACT

A foam pump includes a fluid cylinder, an air cylinder, and a mixing chamber, in which the fluid cylinder is adapted to draw a fluid therein in a priming stroke, and to pump the fluid into the mixing chamber in a dispensing stroke, in which the air cylinder is adapted to draw air therein in a priming stroke, and to pump the air into the mixing chamber in a dispensing stroke, in which the mixing chamber includes a fluid through-flow axis, in which the fluid cylinder and the air cylinder are co-axial with one another and are aligned on a second axis which is substantially normal to the fluid throughflow axis, in which the fluid cylinder and the air cylinder are provided with a common piston member, and in which the foam pump includes spring means adapted to bias the common piston member to perform a priming stroke of the fluid cylinder and the air cylinder.

16 Claims, 3 Drawing Sheets

(56) References Cited

FOREIGN PATENT DOCUMENTS

| | | |
|---|---|---|
| EP | 1 118 389 A1 | 7/2001 |
| EP | 1 266 696 | 12/2002 |
| GB | 2 362 340 | 11/2001 |
| WO | WO 95/26831 | 10/1995 |
| WO | WO 96/02178 | 2/1996 |
| WO | WO 97/13585 | 4/1997 |
| WO | WO 99/49769 | 10/1999 |
| WO | WO 03/059524 | 7/2003 |
| WO | WO 2004/044534 | 5/2004 |
| WO | WO 2005/105320 | 11/2005 |

* cited by examiner 100
102
101

FOAM PUMP

This Application is the U.S. National Phase of International Application Number PCT/GB2010/001175 filed on Jun. 15, 2010.

The present invention relates to a foam pump, for use particularly, but not exclusively, to generate foamed soap products from a liquid soap and air.

Foam pumps are well known, and comprise separate fluid and air cylinders adapted to force a subject liquid and air together inside a mixing chamber. The co-mingled liquid and air is then forced over one or more foaming meshes, before being dispensed from a nozzle. The liquid is drawn from a cartridge to which the pump is attached, and air is drawn from atmosphere, either through the nozzle or from an inlet elsewhere on the device.

In many cases the fluid and air cylinders are co-axial, which is to say one is arranged inside the other on the same axis. Most pumps are constructed about a fluid throughflow axis, with a fluid inlet, mixing chamber, foaming chamber and fluid outlet arranged sequentially on said axis, and with the co-axial fluid and air cylinders also arranged on said axis, either sequentially or radially in relation to the other features.

Such pumps are manually operated by a plunger part, depression of which forces the fluid and air cylinders to perform a dispensing stroke in unison, which forces fluid and air therein into the mixing chamber, through into the foaming chamber and then out of the nozzle. A return spring is provided somewhere on the pump, or on the dispensing device with which it is used, which forces the fluid and air cylinders to perform a priming stroke in unison, which draws fluid and air therein, ready for the dispensing stroke.

Typical examples of such foam pumps are shown in EP0613728 to Daiwa Can Company, EP0703831 to Sprintvest Corporation N. V., EP0853500 to Park Towers International B. V., EP0984715 to DEB IP Limited, EP1266696 to Taplast S.p.A., EP1444049 to Bentfield Europe B.V., WO 2004/044534 to Continental AFA Dispensing Company, WO 2005/105320 to Airspray N.V., and U.S. Pat. No. 6,409,050 and GB2362340 to Ophardt.

In all of the above cases, because the fluid and air cylinders are arranged on the fluid throughflow axis, the plunger part also moves back and forth along said axis. This is appropriate when the pump is located at the top of a container of fluid, and is operated by a downward push on the operating plunger, but it is not particularly suitable for use inside a wall mounted dispensing device which dispenses foam from an underside thereof. Such dispensers are commonly operated by lateral movement of a cover or trigger, which movement is substantially normal to the fluid throughflow axis of the pump mounted underneath the container of fluid.

In EP0703831 to Sprintvest Corporation N. V., EP0984715 to DEB IP Limited and U.S. Pat. No. 6,409,050 to Ophardt, the pumps are arranged inside wall-mounted dispensers underneath containers of fluid mounted therein, and in order to deal with the vertical alignment of the fluid throughflow axis of the pump a special spring-loaded trigger is provided in each case, which converts a lateral movement into a vertical one to operate the pump. These constructions are not ideal because the transmission of the lateral movement of the trigger into a vertical one is not well controlled, leading to an adverse twisting of the pump which results in leakages and failures. Further, these constructions comprise an excess of independent parts, which adds costs.

EP1444049 to Bentfield Europe B.V. provides a slightly different solution, by arranging the pump at an angle to vertical, but this is also not ideal because it increases the size of the wall-mounted dispensing device.

The present invention is intended to provide a solution to some of the above described problems.

Therefore, according to the present invention, a foam pump comprises a fluid cylinder, an air cylinder, and a mixing chamber, in which the fluid cylinder is adapted to draw a fluid therein in a priming stroke, and to pump said fluid into said mixing chamber in a dispensing stroke, in which the air cylinder is adapted to draw air therein in a priming stroke, and to pump said air into said mixing chamber in a dispensing stroke, in which the mixing chamber comprises a fluid throughflow axis, in which the fluid cylinder and the air cylinder are co-axial with one another and are aligned on a second axis which is substantially normal to said fluid throughflow axis, in which the fluid cylinder and the air cylinder are provided with a common piston member, and in which the foam pump comprises spring means adapted to bias said common piston member to perform a priming stroke of the fluid cylinder and the air cylinder.

Thus, the present invention provides a foaming pump in which an axis of operation of the fluid and air cylinders is substantially normal to the fluid throughflow axis of the pump. As such, the pump of the present invention is suitable for use in a wall-mounted foam dispenser which dispenses foam from an underside thereof and is operated by lateral depression of the cover, because the fluid throughflow axis can be substantially vertical, while the movement of the common piston member can be aligned with lateral movement of the cover.

(The term "substantially normal to" with regard to the relationship between the second axis and the fluid throughflow axis is intended to include a range of 15 degrees or so either side of 90 degrees, so the invention includes a slight canting of the fluid through flow axis in relation to said second axis to allow for foam to be dispensed at a slight angle towards a user, and not directly downwards.)

With the common piston member both the fluid and air cylinders are operated in unison to produce the foam, and with the return spring, the pump automatically performs a priming stroke after each dispensing stroke.

Preferably the foam pump can comprise a valve chamber provided with a fluid inlet and a fluid outlet, in which said fluid inlet and said fluid outlet can be arranged on said fluid throughflow axis, and in which the fluid cylinder can be in operative connection with said valve chamber. The fluid inlet can be controlled by a first valve member adapted to open during a priming stroke of said fluid cylinder and to shut during a dispensing stroke of said fluid cylinder, and the fluid outlet can be controlled by a second valve member adapted to shut during a priming stroke of said fluid cylinder and to open during a dispensing stroke of said fluid cylinder.

With this construction the positive and negative pressure generated by the movement of the fluid piston in use acts on a common inlet and outlet valve chamber in a simple and efficient construction.

In one construction the air cylinder can be disposed inside the fluid cylinder, but in a preferred embodiment the air cylinder can be radially arranged around said fluid cylinder. With this construction the valve chamber and the mixing chamber can be conveniently sequentially aligned on said fluid throughflow axis, with the air cylinder in operative connection with said mixing chamber, downstream of the valve chamber.

The piston member can comprise a fluid piston and an air piston, which can be co-axial with one another and be disposed in said fluid cylinder and said air cylinder respectively.

The spring means can be any known type of spring which is capable of acting to bias the piston member, including any type of extension or compression spring external of the fluid or air cylinder, or any such spring inside the foam pump acting on the active surfaces of the fluid or air pistons. However, in a preferred construction the spring means can comprise a coil spring disposed in the air cylinder and around the fluid cylinder, which can act against said air piston.

The first and second valve members in the valve chamber can be any known design, however in one embodiment of the invention the second valve member can comprise a resilient annular cone mounted on a boss, which annular cone can comprise an outer rim, which can be urged against an inner surface of the valve chamber by a negative pressure generated therein during a priming stroke of the fluid cylinder, and which can be forced away from the inner surface by a positive pressure generated therein during a dispensing stroke of the fluid cylinder.

The air cylinder can be connected to the mixing chamber by an air passageway which can extend from a first opening at a bottom of the air cylinder to a second opening in the mixing chamber, which faces in a substantially opposite direction to the flow of fluid entering the mixing chamber from the valve chamber in use.

With this construction of the second valve and the second opening, there is provided an advantageous co-mingling environment for the fluid and air. In particular, the flow of air in an opposite direction to the flow of fluid leads to a thorough mixing of the two substances, and the underside of the cone provides a high pressure area where the body of the cone reduces in size adjacent to the boss, which high pressure area forces the mixed fluid and air to travel back in the fluid flow direction. This turbulent movement inside the mixing chamber ensures that all the mixed fluid and air is cleared out of the mixing chamber, preventing the build up of residue in use.

The boss can be mounted on a sleeve component provided in the mixing chamber, and an aperture can be formed between the boss and the sleeve, through which the mixed air and fluid can pass in use.

This sleeve component can also provide for the air to be directed to the mixing chamber in the manner described above. In particular, the air passageway from the air cylinder can comprise a first portion which can extend from the first opening to an intermediary opening in the inner surface of the mixing chamber. The sleeve component can overlie this intermediary opening, and it can comprise an annular trough in an outer surface thereof which can be aligned with the intermediary opening and can define a second portion of the air passageway. The sleeve component can then comprise a flat wasted section extending axially from the annular trough to an upper rim of the sleeve component, and defining a third portion of the air passageway. Therefore, the air enters the trough, travels around it in both directions to opposed openings where the wasted section begins, and then up the wasted section and into the mixing chamber where it collides with the fluid entering from above.

It is possible for the air cylinder to draw air therein from an outlet nozzle of the pump, however, in a preferred construction the air cylinder can be provided with one or more apertures through which air from atmosphere can be drawn. These apertures can be provided with a third valve means adapted to open during a priming stroke of the air cylinder and to shut during a dispensing stroke thereof.

The one or more apertures can be provided at the bottom of the air cylinder, and the third valve means can comprise a resilient annular disc disposed at the bottom of the air cylinder, overlying the apertures. The disc can be lifted away from the bottom of the air cylinder to open the apertures by a negative pressure generated inside the air cylinder during a priming stroke thereof, and the disc can be urged against the bottom of the air cylinder to shut the apertures by a positive pressure generated inside the air cylinder during a dispensing stroke thereof.

In an expedient embodiment of the invention, the fluid piston and air piston can be self-sealing against the walls of the fluid cylinder and air cylinder respectively. This is a simple construction which saves on separate sealing components, and can be readily achieved with modern materials.

The first valve member which controls the fluid inlet of the valve chamber can be any known fluid valve, but preferably it can comprise a ball valve.

The co-mingled fluid and air exiting the mixing chamber is not a foam, so as in known foam pumps a foaming chamber can be provided, which can be sequentially aligned on said fluid throughflow axis after the mixing chamber. The foaming chamber can comprise one or more foaming meshes adapted to generate a foam to be dispensed from the mixed air and fluid forced into the foaming chamber. In a preferred construction two spaced apart foaming meshes can be provided.

The foam pump of the invention can be used with any type of dispenser, but in one construction it can be adapted to be used with a wall-mounted dispenser which is operated by generally lateral movement of a cover thereof. Therefore the piston member can comprise an operating plunger provided with an operative depression surface at an outer end thereof. The inside surface of the cover of a dispenser like that described above can bear against the operative surface when it is depressed, in order to operate the pump. The action of the spring can then push the operative surface back out again, returning the cover of the dispenser to its starting position.

In an alternative embodiment, the foam pump of the invention can be adapted to be used with a particular type of wall-mounted dispenser, in which the cover thereof is attached to a base with a hinge, and is rotatable about said hinge towards and away from said base, and in which the cover is connected to the foam pump via a pivoting linkage adapted to convert the rotational movement of the cover into a linear movement of the operating plunger. In such an arrangement the operating plunger is fixed to the cover via this pivoting linkage. The pivoting linkage can take one of several different forms, but an expedient arrangement comprises a track provided on the cover, through which a ball-shaped sliding member on the operating plunger can travel in use. Therefore, the piston member can comprise an operating plunger provided with a substantially ball-shaped resilient sliding member at an outer end thereof.

The invention can be performed in various ways, but two embodiments will now be described by way of example, and with reference to the accompanying drawings, in which.

Figure 1:
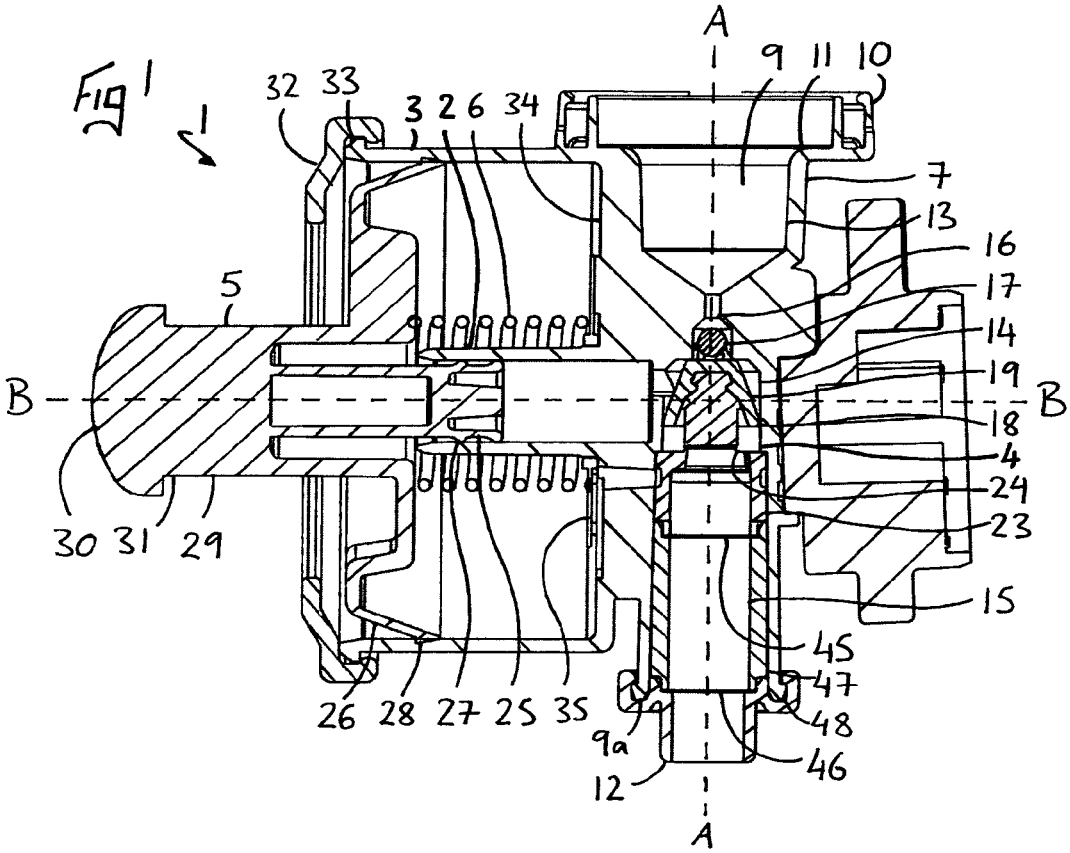
FIG. 1 is a cross-sectional side view of a first foam pump according to the invention.

As shown in FIG. 1, a foam pump 1 comprises a fluid cylinder 2, an air cylinder 3, and a mixing chamber 4. As described further below, the fluid cylinder 2 is adapted to draw a fluid therein in a priming stroke, and to pump said fluid into said mixing chamber 4 in a dispensing stroke, and the air cylinder 3 is adapted to draw air therein in a priming stroke, and to pump said air into said mixing chamber 4 in a dispensing stroke. The mixing chamber 4 comprises a fluid throughflow axis A-A. The fluid cylinder 2 and the air cylinder 3 are co-axial with one another and are aligned on a second axis B-B which is substantially normal to said fluid throughflow axis A-A. The fluid cylinder 2 and the air cylinder 3 are provided with a common piston member 5, and the foam pump 1 comprises spring means, in the form of coil spring 6, which is adapted to bias the common piston member 5 to perform a priming stroke of the fluid cylinder 2 and the air cylinder 3.

The foam pump 1 comprises a body 7 with a bore 9 arranged on the axis A-A. A container coupling 10 is provided at a first end 11 of the bore 9, and an outlet nozzle component 12 is attached to a second end 9*a* of the bore 9. Arranged sequentially in the bore 9 is a fluid inlet funnel 13, a valve chamber 14, the mixing chamber 4, and a foaming chamber 15.

The fluid and air cylinders 2 and 3 are integrally formed as a part of the body 7, and as is clear from FIG. 1, the fluid cylinder 2 is arranged inside the air cylinder 3, and is aligned, and in operative connection with, the valve chamber 14. The air cylinder 3 is in operative connection with the mixing chamber 4, downstream of the valve chamber 14, as described further below.

Figure 2:
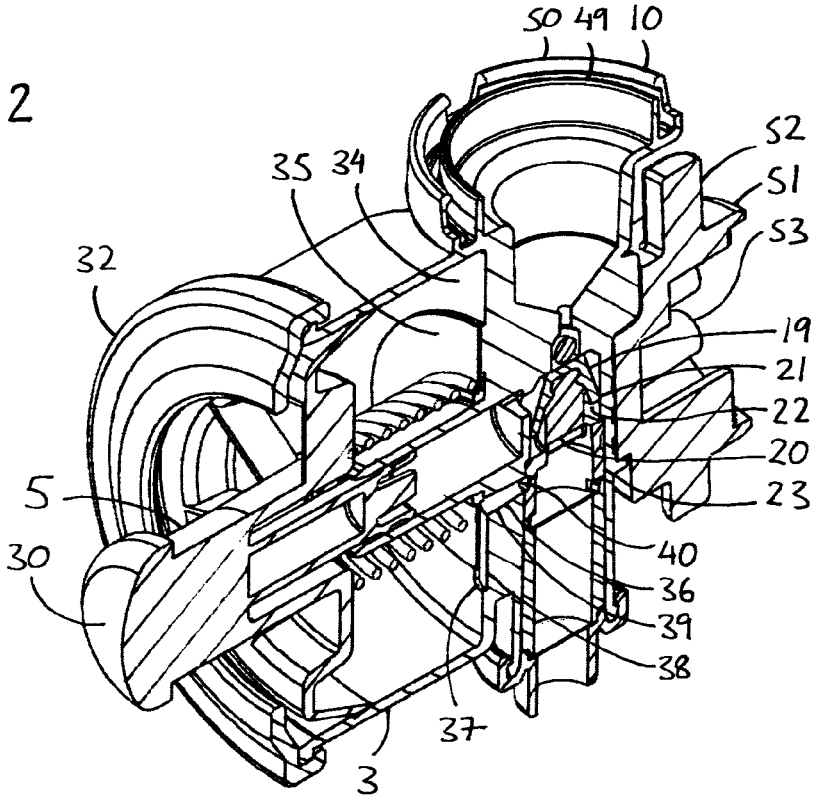
FIG. 2 is a cross-sectional perspective view of the first foam pump as shown in FIG. 1.

The valve chamber 14 is provided with a fluid inlet 16 controlled by ball valve 17, and a fluid outlet 18 controlled by cone valve 19. Referring to FIG. 2, the cone valve 19 is mounted on a boss 20 and comprises an outer rim 21, which is urged against an inner surface 22 of the valve chamber 14 by negative pressure generated therein during a priming stroke of the fluid cylinder 2, and which is lifted away from the inner surface 22 by a positive pressure generated therein during a dispensing stroke of the fluid cylinder 2.

The boss 20 is mounted on a sleeve component 23 disposed in the mixing chamber 4, and an aperture 24 is formed between the boss 20 and the sleeve 23, through which mixed air and fluid pass in use, as described further below.

Housed within the fluid and air cylinders 2 and 3 is piston member 5, which comprises a fluid piston 25 and an air piston 26, which are both self-sealing against the fluid and air cylinders 2 and 3 respectively, by virtue of resilient flanges 27 and 28 in each case.

The piston member 5 has an operating plunger 29, which comprises an operative depression surface 30 at an outer end 31 thereof, which is adapted to co-operate with the inside surface of a dispensing device with which the foam pump 1 is used, as described further below. The piston member 5 is secured inside the fluid and air cylinders 2 and 3 by an annular end cap 32, fastened to the air cylinder 3 with a snap-fit coupling 33.

The air cylinder 3 is provided with four apertures (not visible) at a bottom 34 thereof, through which air from atmosphere can be drawn. A resilient annular disc 35 is disposed at the bottom 34 of the air cylinder 3, overlying the apertures. The disc 35 lifts away from the bottom 34 of the air cylinder 3 to open the apertures when a negative pressure is generated inside the air cylinder 3 during a priming stroke thereof, and the disc 35 is urged against the bottom 34 of the air cylinder 3 to shut the apertures when a positive pressure is generated inside said air cylinder 3 during a dispensing stroke thereof.

Referring to FIG. 2, the air cylinder 3 is connected to the mixing chamber 4 by an air passageway 36. This begins at a first opening 37 at the bottom 34 of the air cylinder 3, which opening 37 is radially located outside the disc 35. The opening 37 is a part of an elongate trough 38 which extends under the disc 35 to a bore 39 perpendicular thereto, which leads to an intermediary opening 40 in the inner surface 22 of the mixing chamber 4. As is clear from FIG. 2, the sleeve component 23 overlies this opening 40.

Figure 4:
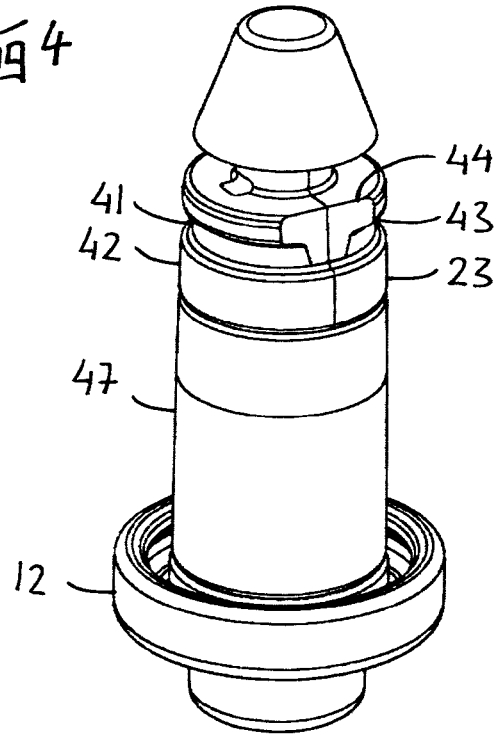
FIG. 4 is a perspective view of internal stacked components forming a part of the first foam pump as shown in FIG. 1.

Referring now to FIG. 4, which shows the sleeve component 23 and its axially associated parts in isolation, the sleeve component 23 comprises an annular trough 41 in an outer surface 42 thereof. As is clear from FIGS. 1 and 2, this trough 41 is aligned with the intermediary opening 40. The sleeve component 23 also comprises a flat wasted section 43 extending axially from the annular trough 41 to an upper rim 44 of the sleeve component 23.

Figure 3:
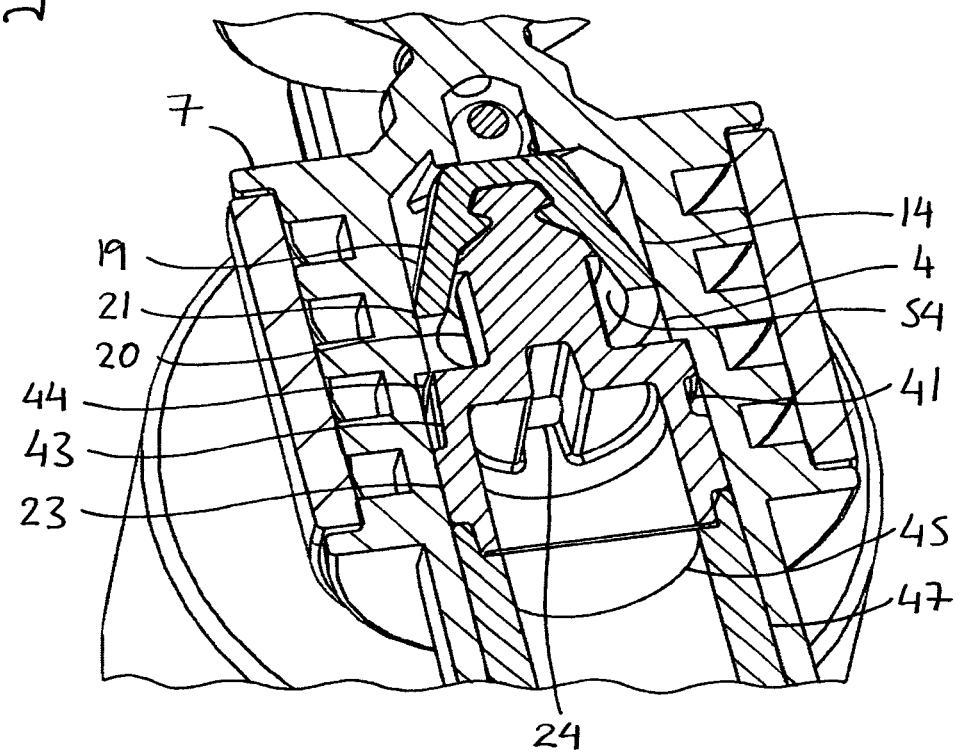
FIG. 3 is a cross-sectional perspective view of a part of the first foam pump as shown in FIG. 1.

As shown in FIG. 3, this wasted section 43 defines a passageway from the trough 41 to a second opening 44 of the air passageway 36. The second opening 44 faces in an opposite direction to the flow of fluid entering the mixing chamber 4 around the outer rim 21 of the cone valve 19.

Referring back to FIG. 1, the foaming chamber 15 comprises two foaming meshes 45 and 46. The first mesh 45 is disposed between the sleeve component 23 and a mounting sleeve 47, while the second mesh 46 is disposed between the mounting sleeve 47 and the nozzle component 12. The nozzle component 12 is fastened to the body 7 with a snap-fit coupling 48, and this holds the second mesh 46, the mounting sleeve 47, the first mesh 45 and the sleeve component 23 in position inside the bore 9.

As shown in FIG. 1, coil spring 6 is disposed in the air cylinder 3, and around the fluid cylinder 2. It is a compression coil spring, which acts against the air piston 26 to bias the piston member 5 to perform a priming stroke. The coil spring 6 is mounted inside the foam pump 1 in a state of compression by the end cap 32, and it performs three functions: i) it works to hold the piston member 5 in an outermost position after a priming stroke, ii) it acts as a dampening means during the performance of a dispensing stroke, and iii) it acts as a return spring to urge the piston member 5 to perform a priming stroke.

The foam pump 1 shown in the Figures is adapted to co-operate with a container of soap to be dispensed. Referring to FIG. 2, the container coupling 10 is a snap-fit coupling comprising an annular boss 49 with four resilient part-annular arms 50 arranged around it (only two of which are visible in FIG. 2). The coupling 10 is adapted to fasten to a mounting boss provided on a container of soap (not shown). In this particular case, the foam pump 1 is disposable, and is intended to be supplied ready affixed to a container of soap, and disposed of when the container is spent.

The foam pump 1 is also provided with an annular mounting boss 51 which is clipped to its rear. This mounting boss 51 comprises a pair of bayonet locking pins 52 adapted to co-operate with a bayonet socket on a dispensing device to which it is intended to be mounted (not shown). The mounting boss 51 also comprises a shaped profile 53, which is adapted to co-operate with a corresponding shaped profile provided on the dispensing device. This feature is designed to prevent incorrect containers of soap being fitted to particular dispensers.

The foam pump 1 operates as follows. The pump 1 is mounted to the underside of a container of liquid soap to be dispensed (not shown), and affixed thereto by the coupling 10. A clear fluid passageway from the container is created, and the fluid inlet funnel 13 is flooded with liquid soap.

To prime the pump 1 the piston member 5 is driven by the coil spring 6 up the fluid and air cylinders 2 and 3. The negative pressure generated by the movement of the fluid piston 25 sucks soap from the fluid inlet funnel 13 into the valve chamber 14, through the fluid inlet 16. The ball valve 17 is drawn away from the fluid inlet 16 so it stays open. The negative pressure also urges the outer rim 21 of the cone valve 19 against the inner surface 22 of the valve chamber 14, so it stays shut. Soap floods the valve chamber 14 and is drawn into the fluid cylinder 2.

At the same time, the negative pressure generated by the movement of the air piston 26 lifts the resilient disc 35 off the bottom 34 of the air cylinder 3, and draws air therein.

The movement of the piston member 5 is arrested by the end cap 32, and the foam pump 1 is primed with liquid soap and air, ready to be mixed and dispensed as a foam.

The pump 1 is fitted in use inside a dispensing device comprising a base and a cover hinged thereto (not shown). The mounting boss 51 co-operates with a bayonet socket provided on the base, and the cover is applied in a floating manner to the operative surface 30 of the piston member 5. To perform a dispensing stroke the cover is depressed by the user, and it drives the piston member 5 down the fluid and air cylinders 2 and 3.

The positive pressure generated by the movement of the fluid piston 25 forces the soap from the fluid cylinder 2 and the valve chamber 14 into the mixing chamber 4, through the fluid outlet 18. The outer rim 21 of the cone valve 19 is lifted away from the inner surface 22 of the of the valve chamber 14, creating an annular opening. The ball valve 17 is forced into the fluid inlet 16, so it shuts.

At the same time, the positive pressure generated by the movement of the air piston 26 forces the air therein into the mixing chamber 4, through the air passageway 36. The disc 35 is urged against the bottom 34 of the air cylinder 3, so the air apertures are shut.

As referred to above, the second opening 44 of the air passageway 36 faces in the opposite direction to the flow of liquid soap entering the mixing chamber 4. As such, the air and liquid soap collide, and this leads to a thorough initial mixing of the two substances, at least in the region of the second opening 44.

In addition, referring to FIG. 3, the shape of the underside 54 of the cone valve 19 provides for a high pressure area where the body of the cone reduces in size adjacent to the boss 20. This high pressure area forces the mixed fluid and air to circulate thoroughly inside the mixing chamber 4, and to generally travel in the fluid flow direction towards the aperture 24. This turbulent movement inside the mixing chamber 4 ensures that all the mixed soap and air is cleared out of the mixing chamber 4, preventing the build up of residue in use.

The co-mingled liquid soap and air is forced by the combined pressure of the fluid and air pistons 25 and 26 through the aperture 24 into the foaming chamber 15. This pressure then forces the co-mingled soap and air over the two meshes 45 and 46, which turns the mixture into a foam. The generated foam then exits the pump 1 under pressure through the nozzle component 12, and drops into the hand or hands of the user.

Once the dispensing stroke has been completed, and the user removes pressure from the cover of the dispenser, the foam pump 1 performs another automatic priming stroke as described above, loading the fluid and air cylinders 2 and 3 with liquid soap and air, and pushing the cover of the dispenser back out again.

Figure 5:
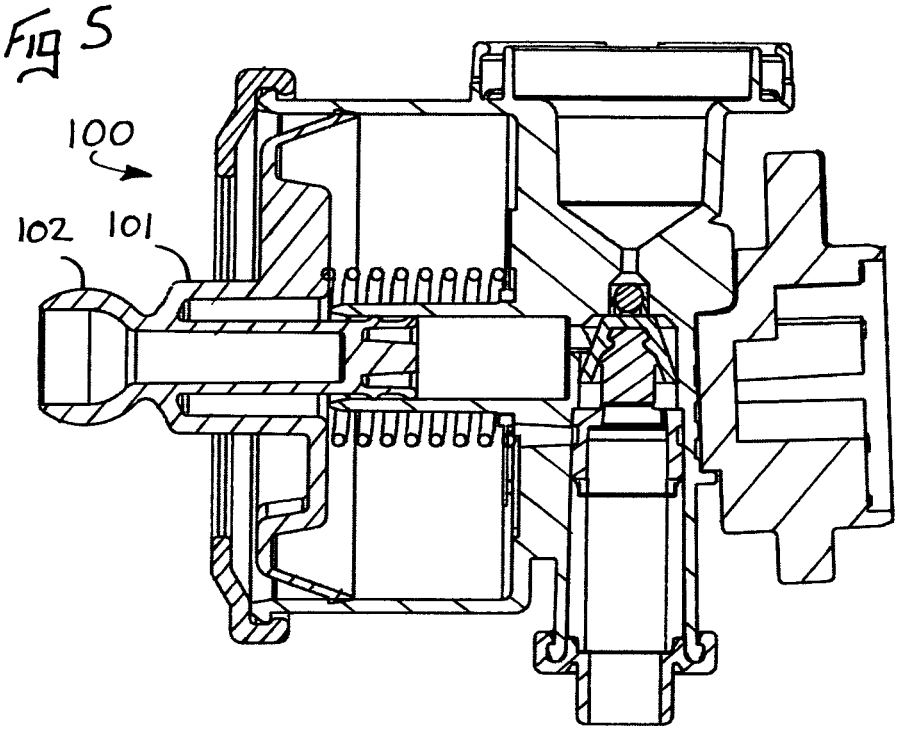
FIG. 5 is a cross-sectional side view of a second foam pump according to the present invention.

The above described embodiment can be altered without departing from the scope of claim 1. In particular, in one alternative embodiment shown in FIG. 5, a foam pump 100 is like foam pump 1 described above, except that it is adapted to be used with a particular type of wall-mounted dispenser, in which the cover thereof is attached to a base with a hinge, and is rotatable about said hinge towards and away from said base, and in which the cover is connected to the foam pump via a pivoting linkage adapted to convert the rotational movement of the cover into a linear movement of the operating plunger. The pivoting linkage comprises a track provided on the cover, through which a ball shaped sliding member can travel in use, and as such the operating plunger 101 comprises a substantially ball-shaped resilient sliding member 102 at an outer end thereof.

In other alternative embodiments (not shown) the spring means of the invention comprises other springs capable of acting to bias the piston member, including extension and compression springs external of the fluid or air cylinder, and a compression spring inside the fluid cylinder.

Some of the features forming a part of the foam pumps 1 and 100 are not essential to the invention, and could be omitted, for example the container coupling 10 and mounting boss 51 which are specific to particular applications. Therefore, in other embodiments (not shown) these features are dispensed with, or replaced with other known soap container and/or dispenser interfaces.

Thus, the present invention provides a foam pump suitable for use inside a wall-mounted dispensing device, by virtue of the perpendicular arrangement of the fluid throughflow axis A-A and the co-axial fluid and air cylinders 2 and 3. In addition, the foam pump of the invention comprises an expedient internal return and dampening spring 6, conveniently housed under compression within the air cylinder 3, around the fluid cylinder 2. Further, the manner in which the air and soap collide and are moved under pressure inside the mixing chamber 4 leads to a high degree of premixing of the soap and air prior to foaming, which results in a high quality foam being produced.

The invention claimed is:

1. A foam pump comprising a fluid cylinder, an air cylinder, and a mixing chamber, in which the fluid cylinder is adapted to draw a fluid therein in a priming stroke, and to pump said fluid into said mixing chamber in a dispensing stroke, in which the air cylinder is adapted to draw air therein in a priming stroke, and to pump said air into said mixing chamber in a dispensing stroke, in which the mixing chamber comprises a fluid throughflow axis, in which the fluid cylinder and the air cylinder are co-axial with one another and are aligned on a second axis which is substantially normal to said fluid throughflow axis, in which the fluid cylinder and the air cylinder are provided with a common piston member, in which the foam pump comprises spring means adapted to bias said common piston member to perform a priming stroke of the fluid cylinder and the air cylinder in which the foam pump further comprises a valve chamber provided with a fluid inlet and a fluid outlet, in which said fluid inlet and said fluid outlet are arranged on said fluid throughflow axis, in which the fluid cylinder is in operative connection with said valve chamber, in which said fluid inlet is controlled by a first valve member adapted to open during a priming stroke of said fluid cylinder and to shut during a dispensing stroke of said fluid cylinder, and in which said fluid outlet is controlled by a second valve member adapted to shut during a priming stroke of said fluid cylinder and to open during a dispensing stroke of said fluid cylinder, and in which said second valve member comprises a resilient annular cone mounted on a boss, in which said annular cone comprises an outer rim, in which said outer rim is urged against an inner surface of said valve chamber by a negative pressure generated inside said valve chamber during a priming stroke of said fluid cylinder, and in which said outer rim is forced away from said inner surface by a positive pressure generated inside said valve chamber during a dispensing stroke of said fluid cylinder.

2. A foam pump as claimed in claim 1 in which said air cylinder is radially arranged around said fluid cylinder, in which the valve chamber and the mixing chamber are sequentially aligned on said fluid throughflow axis, and in which the air cylinder is in operative connection with said mixing chamber.

3. A foam pump as claimed in claim 2 in which said piston member comprises a fluid piston and an air piston, in which said fluid piston and said air piston are co-axial with one another and disposed in said fluid cylinder and said air cylinder respectively.

4. A foam pump as claimed in claim 3 in which said spring means comprises a coil spring disposed in said air cylinder and around said fluid cylinder, and which acts against said air piston.

5. A foam pump as claimed in claim 1 in which the air cylinder is connected to said mixing chamber by an air passageway which extends from a first opening at a bottom of said air cylinder to a second opening in said mixing chamber, and in which said second opening faces in a substantially opposite direction to the flow of fluid entering the mixing chamber from the valve chamber in use.

6. A foam pump as claimed in claim 5 in which said boss is mounted on a sleeve component provided in said mixing chamber, in which an aperture is formed between said boss and said sleeve component through which mixed air and fluid passes in use.

7. A foam pump as claimed in claim 6 in which said air passageway comprises a first portion which extends from said first opening to an intermediary opening in said inner surface of said mixing chamber, in which said sleeve component overlies said intermediary opening, in which said sleeve component comprises an annular trough in an outer surface thereof which is aligned with said intermediary opening and defines a second portion of said air passageway, and in which said sleeve component comprises a flat wasted section extending axially from said annular trough to an upper rim of said sleeve component and defining a third portion of said air passageway.

8. A foam pump as claimed in claim 7 in which the air cylinder is provided with one or more apertures through which air from atmosphere is drawable, in which said one or more apertures are provided with a third valve means adapted to open during a priming stroke of said air cylinder and to shut during a dispensing stroke of said air cylinder.

9. A foam pump as claimed in claim 8 in which said one or more apertures are provided at the bottom of the air cylinder, in which said third valve means comprises a resilient annular disc disposed at the bottom of the air cylinder and overlying said one or more apertures, in which said annular disc is lifted away from the bottom of the air cylinder to open said one or more apertures by a negative pressure generated inside said air cylinder during a priming stroke thereof, and in which said annular disc is urged against the bottom of the air cylinder to shut said one or more apertures by a positive pressure generated inside said air cylinder during a dispensing stroke thereof.

10. A foam pump as claimed in claim 3 in which said fluid piston and said air piston are self-sealing against the walls of said fluid cylinder and said air cylinder respectively.

11. A foam pump as claimed in claim 1 in which the first valve member is a ball valve.

12. A foam pump as claimed in claim 1 further comprising a foaming chamber, sequentially aligned on said fluid throughflow axis after said mixing chamber, in which said foaming chamber comprises one or more foaming meshes adapted to generate a foam to be dispensed from mixed air and fluid forced into the foaming chamber in use.

13. A foam pump as claimed in claim 1 in which said piston member comprises an operating plunger provided with an operative depression surface at an outer end thereof.

14. A foam pump as claimed in claim 1 in which said piston member comprises an operating plunger provided with a substantially ball-shaped resilient sliding member at an outer end thereof.

15. A foam pump as claimed in claim 1 in which the air cylinder is provided with one or more apertures through which air from atmosphere is drawable, in which said one or more apertures are provided with a third valve means adapted to open during a priming stroke of said air cylinder and to shut during a dispensing stroke of said air cylinder.

16. A foam pump as claimed in claim 12 in which said piston member comprises an operating plunger provided with an operative depression surface at an outer end thereof.

* * * * *